United States Patent [19]

Murata et al.

[11] Patent Number: 4,769,575

[45] Date of Patent: Sep. 6, 1988

[54] ELECTRON GUN OF AN IMAGE DISPLAY APPARATUS

[75] Inventors: Toshikazu Murata, Takatsuki; Yoshinobu Takesako; Masayuki Takahashi, both of Katano, all of Japan

[73] Assignee: Matsushita Electric Industrial Co., Ltd., Kadoma, Japan

[21] Appl. No.: 890,857

[22] PCT Filed: Nov. 19, 1985

[86] PCT No.: PCT/JP85/00643

§ 371 Date: Jul. 18, 1986

§ 102(e) Date: Jul. 18, 1986

[87] PCT Pub. No.: WO86/03331

PCT Pub. Date: Jun. 5, 1986

[30] Foreign Application Priority Data

Nov. 20, 1984 [JP] Japan ..... 59-244907
Nov. 20, 1984 [JP] Japan ..... 59-244908
Nov. 20, 1984 [JP] Japan ..... 59-244909

[51] Int. Cl.[4] ..... H01J 63/02

[52] U.S. Cl. ..... 313/495; 313/497; 315/366

[58] Field of Search ..... 313/411, 412, 495, 497; 315/366

[56] References Cited

U.S. PATENT DOCUMENTS 4,227,177 4/1985 Watanabe et al. ..... 313/422 X

FOREIGN PATENT DOCUMENTS 58-32897 7/1983 Japan .
59-86139 5/1984 Japan .

*Primary Examiner*—David K. Moore
*Assistant Examiner*—Sandra L. O'Shea
*Attorney, Agent, or Firm*—Cushman, Darby & Cushman

[57] ABSTRACT

An electron gun of a flat plate type image display apparatus for use in a field of an image information apparatus is described. A rear electrode part of the electron guns is formed by a flat plate type rear electrode which has a conductive film on its surface, and is arranged with a constant distance from the plural line electrodes. Plural spacers are disposed between the plural line electrodes (2), with one end of each fixed on the rear electrode and conductive films formed on the surfaces. The fabrication of the electron gun is simplified and furthermore, electric field is stabilized by prevention of generation of electric charge and generation of unevenness of luminance on a surface of an anode.

4 Claims, 4 Drawing Sheets

ELECTRON GUN OF AN IMAGE DISPLAY APPARATUS

DESCRIPTION

1. TECHNICAL FIELD

The present invention relates to an electron gun of a flat type image display apparatus to be used in a field for an image information display apparatus, utilizing thermoelectron emission.

2. BACKGROUND ART

At present, cathode ray tubes are mainly used as display apparatus for color televisions. Conventional cathode ray tubes, however, have a disadvantage that they are very long in depth in comparison with screen size. Consequently, fabrication of a small depth television receiver has been impossible. Recently, an EL (electro luminescence) display apparatus, a plasma display apparatus, a liquid crystal display apparatus, and the like have been developed as a flat type image display apparatus. However their quality and performance in luminance, contrast and color reproducibility are not satisfactory and they are not practicable. If used at all, they have very limited purposes.

In order to display a color television image on a flat type image display apparatus using an electron beam, an image display apparatus for the television is developed, wherein a screen of the image display apparatus is divided in plural sections in the vertical direction, electron beams of the respective sections are deflected vertically to display plural lines, moreover, the screen is divided in plural sections in the horizontal direction, fluorescent substance for red (R), green (G) and blue (B) of the respective sections radiate in turn, and intensities of the electron beams emanated on the fluorescent substance of R, G, B are controlled by color video signals, there by to display a color television image as a whole.

The image display apparatus comprises, as will be described hereinafter, plural line cathodes, a group of electrodes of a vertical convergence electrode, vertical deflection electrodes, electron beam flow control electrodes, for converging, deflecting and accelerating the electron beams emitted from the above-mentioned line cathodes, a horizontal convergence electrode, horizontal deflection electrodes and an electron beam acceleration electrode between an anode and a rear electrode.

In the above-mentioned image display apparatus, the constitution of an electron gun, in a broad sense, consists of a rear electrode, the line cathode, the vertical convergence electrode, the vertical deflection electrode, the electron beam flow control electrode, the horizontal convergence electrode, the horizontal deflection electrode and the electron beam acceleration electrode. More narrowly, the rear electrode, the line cathode and the vertical convergence electrode among the above-mentioned group of electrodes is referred to as the electron gun. The electron gun in the present invention means the narrow configuration referred to above.

The conventional configuration of the electron gun is shown in FIG. 1. The rear electrode 1 has a function of ejecting forward the electron beam which is emitted from the line electrode 2 as an electron beam source, and is formed by a glass plate, a transparent conductive film 1a is formed on its surface opposing to the line electrode 2 by evaporation of, for example, oxidized tin and oxidized indium. The line cathode 2 is stretched horizontally, the plural line cathodes are provided in a vertical direction with a suitable interval (the four line cathodes are shown in FIG. 1). These line cathodes 2 are made of, for example, a tungsten line wherein its diameter is 15–30 micron and oxidized cathode substance of oxidized barium, oxidized strontium and oxidized calcium are coated on the surface thereof by, for example, electrodeposition. The vertical convergence electrode 3 is formed by a etched thin metal plate which is 0.1–0.2 mm in thickness and is made of 426 alloy (Ni: 42%, Cr: 6%, Fe: 52%), or the like, and a film of several micron of silver, platinum, gold or the like is formed on its surface by evaporation or wet plating. The vertical convergence electrode 3 extracts the electron beam emitted from the line cathode 2 forward and converge it.

However, in the above-mentioned configuration, (1) As shown in FIG. 1, fabrication of the rear electrode 1 was difficult because its shape was complicated and high precision was required.

(2) There is defects that the shape of the vertical convergence electrode 3 is changed by heat radiated from the line cathode 2, and furthermore, electric charges arise thereon due to electrons emitted from the line cathode 2, and an electric field in the electric gun become unstable, thereby making uneveness of luminance on the anode surface of the image display apparatus.

DISCLOSURE OF THE INVENTION

A main object of the present invention is to constitute an electron gun of an image display apparatus which is improved in a configuration which is easy to fabricate.

Other object of the present invention is to stabilize an electric field in the electron gun, and is to prevent uneveness of luminance on a surface of an anode of the image display apparatus.

A rear electrode part of the electron gun is constituted by a flat plate type rear electrode which is provided with a conductive film on the surface and is arranged keeping a predetermined distance from the plural line cathodes and plural spacers which are disposed between the plural line cathodes, wherein respective one ends are fixed on the rear electrode and conductive films are formed on their surfaces, thereby the above-mentioned objects of the present invention are achieved.

More specifically, the electron gun of the image display apparatus embodying the present invention comprises plural line cathodes which are disposed in parallel with each other with a given interval, therebetween the flat plate type rear electrode which has a conductive film on the surface and is disposed with a constant distance from the line cathodes, plural spacers which are disposed between the plural line cathodes, respective one end of which being fixed on the rear electrodes and a conductive film being formed on each surface. Plural convergence electrodes for converging the electron beams emitted from the line electrodes.

BEST MODE FOR EMBODYING THE INVENTION

Figure 1:
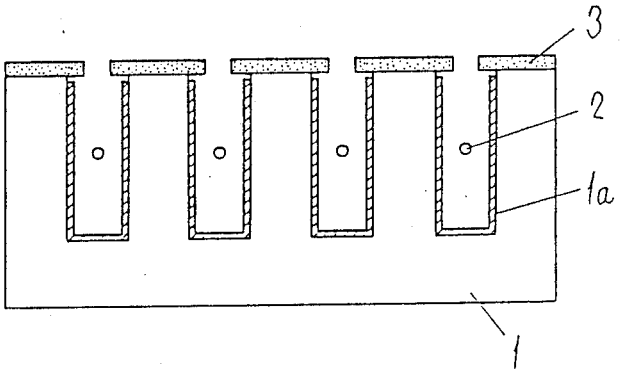
FIG. 1 is the cross-sectional view showing the configuration of the conventional electron guns.
Figure 2:
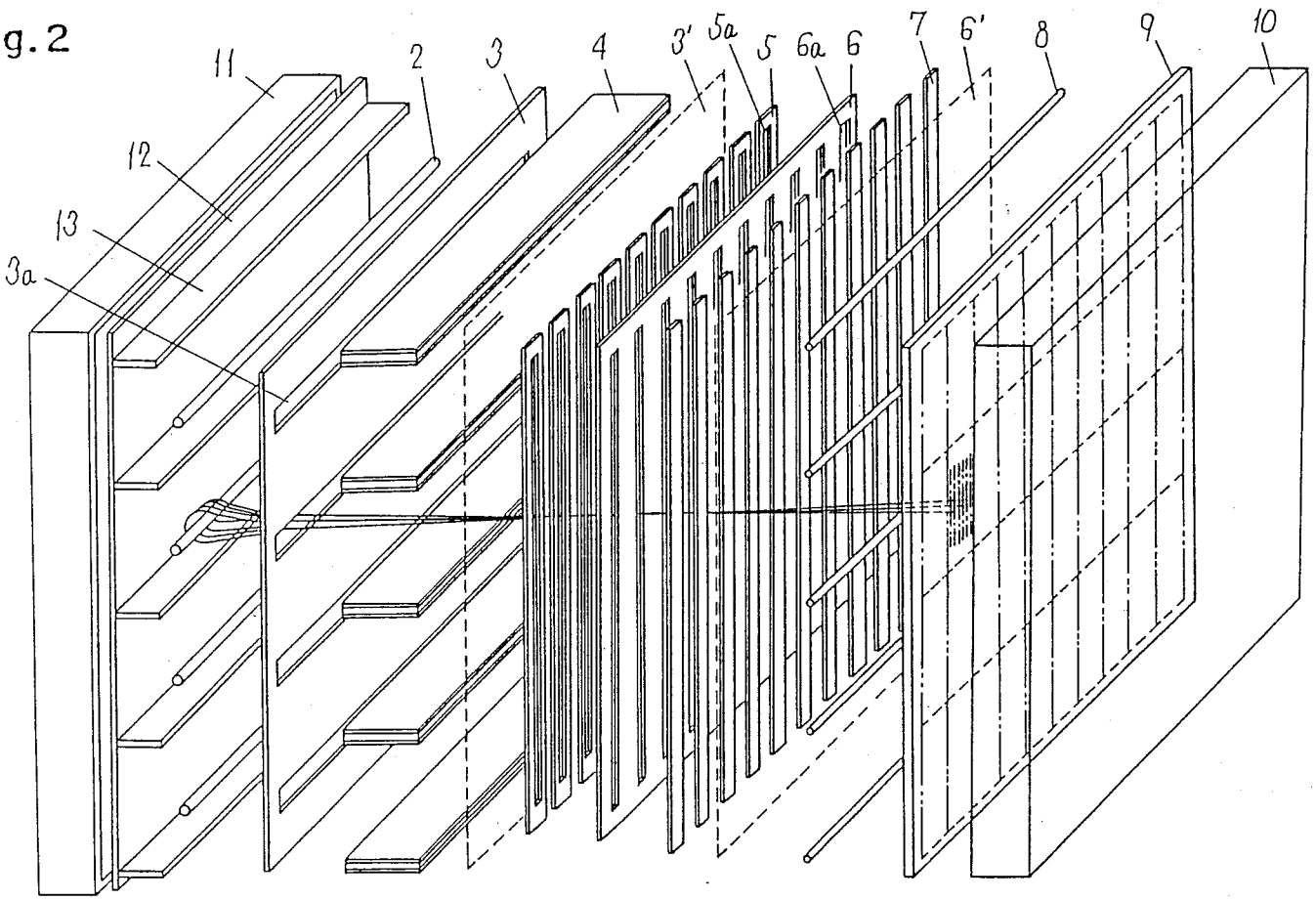
FIG. 2 is an exploded perspective view showing a whole configuration of flat type image dispaly apparatus.

A fundamental configuration of a flat type image display apparatus using an electron gun of the present invention is elucidated on the base of FIG. 2. As shown in the drawing, a glass enclosure 11, a rear electrode parts 12, 13, line cathodes 2 as sources of electron beams, vertical convergence electrodes 3, 3', vertical deflection electrodes 4, electron beam flow control electrodes 5, a horizontal convergence electrode 6, horizontal deflection electrodes 7, a horizontal convergence electrode 6', electron beam acceleration electrodes 8, an anode 9, and glass enclosure 10, 11 are disposed from rear to front in the above-mentioned order. All the components are enclosed in the glass enclosure 10 and 11, and the glass enclosure is evacuated.

The line cathodes 2 are horizontally stretched and disposed to emit horizontally and linearly distributed electron beams. Plural line cathodes 2 are provided with appropriate intervals (although only four line cathodes are shown in FIG. 2). These line cathodes are made by a tungsten line wherein oxide cathode substance is coated on the surface. As will be described later line cathodes are controlled to emit the electron beam during a predetermined time period in turn from the upper line cathode.

The rear electrode parts 12, 13 produce a voltage potential inclination between the vertical convergence electrode 3 and itself, suppress the emission of the electron beams from the line electrodes except the above-mentioned line electrode which is controlled to emit the electron beam during a predetermined time period, and emit emitted electron beam only in frontward direction.

The vertical convergence electrode 3 is formed in that by a conductive plate which has horizontal long slits 3*a* on positions opposing to the respective line cathodes 2, and the electron beams emitted from the line cathode 2 are taken out through the slits 3*a*, and are converged to a vertical direction. The vertical convergence electrode 3' serves the same function.

Plural vertical deflection electrodes 4 are horizontally disposed at a center between the respective slits 3*a*, and the respective vertical deflection electrodes are formed by a insulation substrate with conductive members on both an upper and a lower surface thereof. A vertical deflection voltage is applied across the two conductive members and the electron beams are vertically deflected.

The electron beam flow control electrodes 5 are formed by a rectangular conductive plate with a longitudinal long slit 5*a* thereon, and plural ones thereof are arranged in parallel at a predetermined interval. This respective electron beam flow control electrode 5 horizontally divides the electron beam to every one picture element to be taken out it, and its flow rate is controlled by video signals for displaying respective picture elements. For this purpose, the conductive plates for control electrodes are electrically isolated from each other. In order to display a color image, the respective picture elements are displayed by three color fluorescent substances, R, G and B, and the respective video signals for R, G and B are applied to the respective electron beam flow control electrode 5 in turn.

The horizontal convergence electrode 6 is formed by a conductive plate wherein plural vertically elongated slits 6*a* are disposed on positions opposing to the slits 5*a* of the electron beam flow control electrodes 5, horizontally divided electron beams for the respective picture elements are converged horizontally and is made to be fine electron beams. The horizontal convergence electrode 6' serves the same function.

The horizontal deflection electrodes 7 are disposed on center positions of the respective slits 6a and are formed by plural rectangular conductive plates which are electrically isolated from each other, horizontal deflection voltages are applied across the respective conductive plates, the electron beams for the respective picture elements are horizontally deflected, and the respective fluorescent substances of R, G and B on the anode 9 are irradiated thereby in turn to radiate lights. The range of the deflection, in this example, is equal to a width of one picture element for each electron beam.

The electron beam acceleration electrode 8 are formed by plural conductive wires which are horizontally disposed at similar positions of the vertical deflection electrodes 4, and accelerate the electron beams as they impinge on the anode 9 with sufficient energy.

The back surface of the anode 9 are coated with the fluorescent substances which radiate lights by irradiation of the electron beams, and furthermore, a metal back layer is added thereon (not shown).

Figure 3:
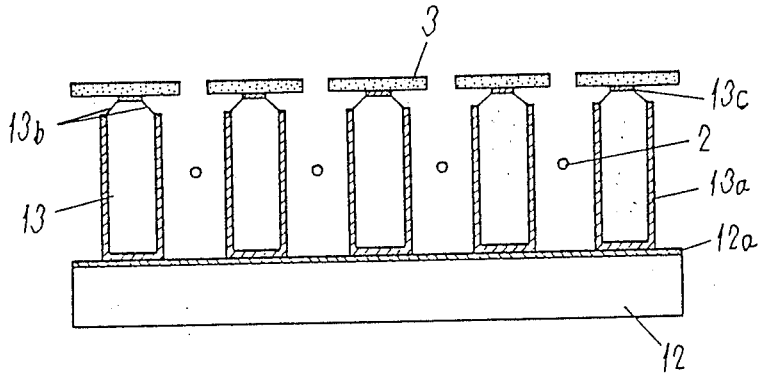
FIG. 3 and FIG. 4 are a cross-sectional view and a perspective view showing configurations of electron guns in an embodiment of the present invention.
Figure 4:
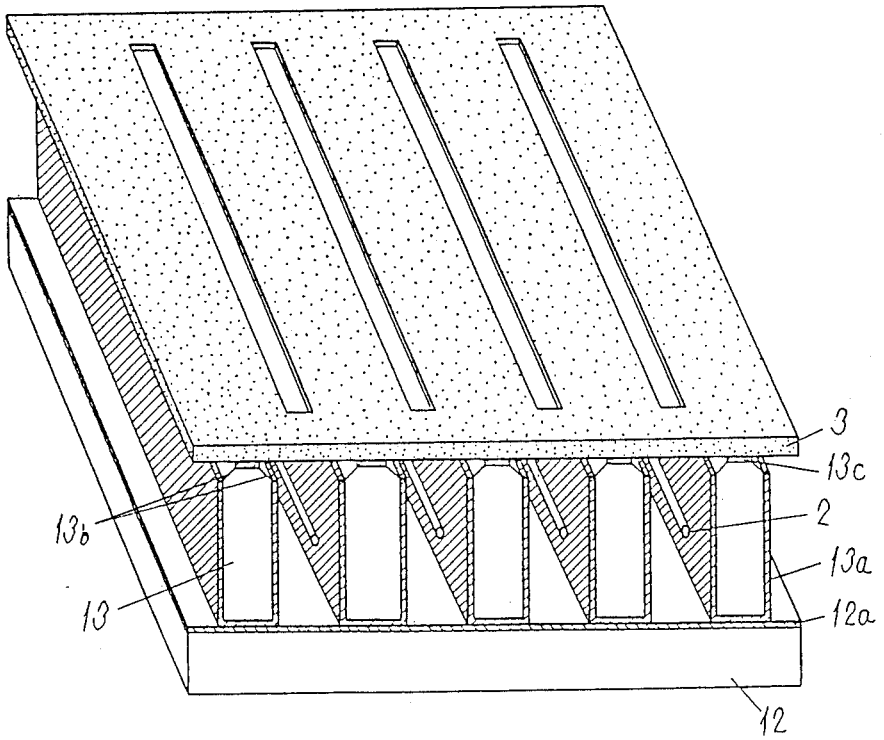

FIG. 3 and FIG. 4 show a configuration of the electron gun in an embodiment of the present invention in simplified manner. Referring to FIG. 3 and FIG. 4, the rear electrode part of the electron gun is configured as being divided into a flat plate 12 and spacers 13 made of glass plates. The electron gun which surround the line cathodes are formed by the flat plate type rear electrode 12 wherein a conductive film 12*a* is formed on one surface, a glass spacers 13 wherein both edges 13*b* of a surface which contact with the vertical convergence electrode 3 are chambered to isolate it from the vertical convergence electrode 3 and a conductive films 13*a* are formed on the whole surface of the opposite surface of the spacer 13 in order to keep conductivity with the rear electrode 12, and it is advantageous in quality, function and fabrication.

The line cathodes 2 are surrounded by the flat plate rear electrode 12 and the glass spacers 13, and the potential of the rear electrode 12 can be equalized with the glass spacer 13, and a uniform electric field can be maintained. Since the vertical convergence electrode 3 is electrically connected with a transparent conductive film 13*c* of the glass spacer 13, even if the vertical convergence electrodes 3 are deformed by heats of the line cathodes 2 the same potentials are maintained, and the uniform electric field can be maintained.

Figure 5:
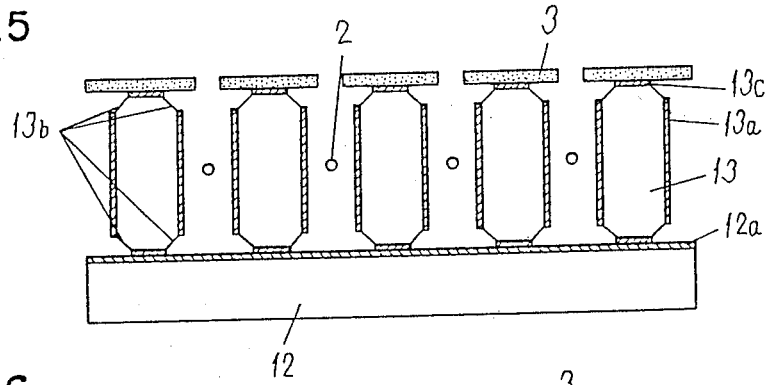
FIGS. 5–8 are cross-sectional views of other embodiments of the present invention.
Figure 6:
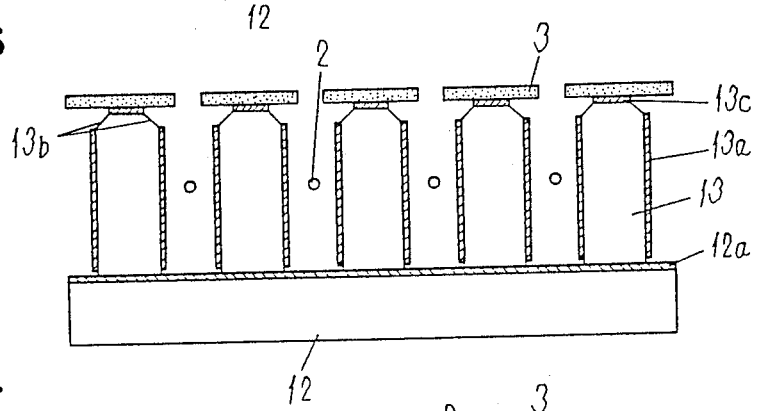

Referring to FIG. 5, both upper and lower end parts 13*b* of the glass spacers 13 are chambered, thereby the vertical convergence electrode 3 is isolated from the glass spacer 13 and the glass spacer 13 is isolated from the flat plate rear electrode 12, and impression of identical potential is prevented. In FIG. 6, in a similar manner shown in FIG. 5, only both edge parts 13*b* of a contacting part of the glass spacer 13 and the vertical convergence electrode 3 are chambered and are isolated, and the transparent conductive films 13*a* are evaporated so as not to make a contact to the rear electrode 12 from electrical conduction with the conductive film 13*a* on the glass spacer 13. Therefore, though the effect in FIG. 6 is identical with that in FIG. 5, their methods in manufacturing are different from each other. In this embodiment, since the transparent conductive film 13*a* is formed on the surface of the glass spacer 13 opposing to the line cathode 2, a generation of electric charges which are induced on the surface of the glass spacer 13 made of glass as dielectric substance by electron beam emitted from the line cathode 2 is prevented, and the electric field in the inside of the electron gun is stabilized, hence it is possible to cancel unevenness of luminance on the anode surface of the image display apparatus. Furthermore, even if the vertical convergence electrode 3 made of 426 metal alloy thin plate of 0.1–0.2 t is deformed by heat of the line cathode 2, the electric field inside of the electron gun can be stabilized, since the transparent films 13*a* are formed on the contacting part of vertical convergence electrode 3 and glass spacer 13*a* in both the embodiments as shown in FIG. 5 and FIG. 6 and the identical potentials can be maintained.

Figure 7:
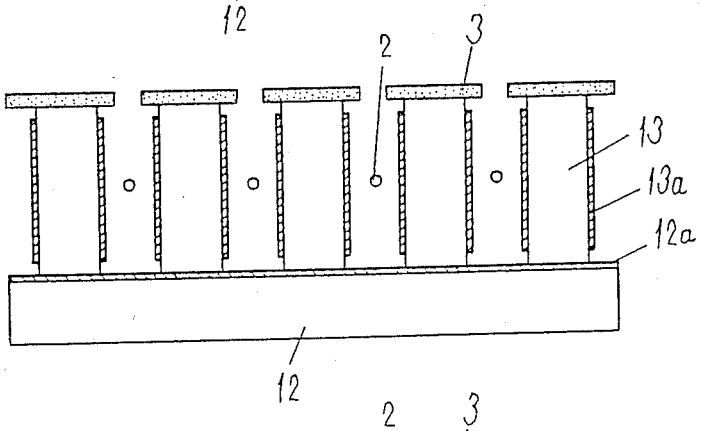
Figure 8:
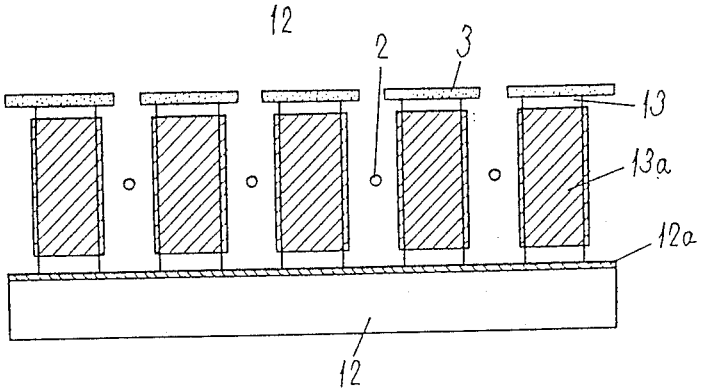

In embodiments as shown in FIG. 7 and FIG. 8, the transparent conductive films 13*a* are formed on the surfaces of the glass spacers 13 opposing to the line cathodes 2, and the electric charges which are induced by the electron beam emitted from the line cathodes 2, on the surfaces of the dielectric glass spacres 13 can be suppressed thereby. Especially in the embodiment of the FIG. 8, the transparent conductive films 13*a* are formed on the whole surfaces of the glass spacers 13, and the electric charge of the glass spacers 13 which are induced by the electron beam emitted from the line cathodes 2 can be made to uni-potential over the whole surfaces of the glass spacers 13.

The embodiments as shown in FIG. 7 and FIG. 8, are the configuration of the electron gun which is used in case that the vertical convergence electrodes 3 and the rear electrodes 12 are thick in thickness and have high stiffness, and they do not make a deformation due to the heat radiated from the line cathodes 2, and the conductive films 13*a* on the surfaces of the glass spacers 13*a* are formed on a desirable area by using appropriate masking material in a deposition process.

As is made clear by the above-mentioned elucidation, in the present invention, the problem in fabrication is settled by the simplified configuration of the electron gun. Generation of electric charge is prevented by providing the transparent conductive films on the surfaces of glass spacers opposing to line cathode. In addition, the electric field is stabilized, dissolution of unevenness of luminance on the surface of an anode of the image display apparatus is realized, and as a result, a long time stability in quality of the image display apparatus and reliability are greatly improved and can be secured, and the effect in practical use is noticeable.

We claim:

1. An electron gun of an image display apparatus comprising:

plural line cathodes arranged in parallel to each other and with a uniform interval therebetween;

a first plate type rear electrode having a conductive film on a surface thereof and disposed at a given distance to said line cathodes;

plural spacers, fixed by one end to said rear electrode and formed with a conductive film on a surface thereof wherein edge parts of a longer side of said spacers are chambered, and said conductive film not being formed on said chambered edge parts; and plural convergence electrodes fixed on the other end of said plural spacers and being for converging electron beams emitted from said line cathodes.

2. An electron gun of an image display apparatus comprising:

plural line cathodes arranged in parallel to each other and with a uniform interval therebetween;

a flat plate type rear electrode having a conductive film on a surface thereof and disposed with a given distance to said line cathodes;

plural spacers, each having two ends, one of said ends having edge areas, the other end of each spacer fixed on said rear electrode and formed with conductive films on a surface thereof, said conductive films not being formed on edge areas along longer sides of said spacers; and plural convergence electrodes fixed on said end having edge areas of said plural spacers and being for converging electron beams emitted from said line cathodes, wherein:

said conductive films formed on sides of the spacers and the conductive film of said rear electrode are electrically connected and the conductive films formed on sides of said spacers and said convergence electrodes are electrically isolated.

3. An electron gun of an image display appartus comprising:

plural line cathodes arranged in parallel to each other and with a uniform interval therebetween;

a flat plate type rear electrode having a conductive film on a surface thereof and disposed with a given distance to said line cathodes;

plural spacers fixed on said rear electrode at one end of each spacer and formed with a conductive film on a surface thereof;

edge parts of a longer side of said spacers being chambered, and said conductive film not formed on said chambered edge parts; and plural convergence electrodes fixed on the other end of said plural spacers and being for converging electron beams, emitted from said line cathodes, wherein:

said conductive film formed on sides of the spacers are electrically isolated from a conductive film formed on said rear electrode and at least one of said convergence electrodes.

4. An electron gun of an image display apparatus comprising:

plural line cathodes arranged in parallel to each other and with a uniform interval therebetween;

a flat plate type rear electrode having a conductive film on a surface thereof and disposed with a given distance to said line cathodes;

plural spacers, each having two ends, one of said ends having edge areas, said plural spacers fixed on said rear electrode at the other end and formed with a conductive film on a surface thereof;

said conductive film not being formed on said edge areas along longer sides of said spacers; and plural convergence electrodes fixed on said end having edge areas of said plural spacers and being for converging electron beams emitted from said line cathodes, wherein:

said conductive film formed on sides of the spacers are electrically isolated from a conductive film formed on said rear electrode and at least one of said convergence electrodes.

* * * * *